US007448116B1

(12) United States Patent
Howell

(10) Patent No.: US 7,448,116 B1
(45) **Date of Patent: *Nov. 11, 2008**

(54) QUICK RELEASE BUCKLE

(75) Inventor: Frank A. Howell, Oxford, ME (US)

(73) Assignee: Illinois Tool Works Inc., Glenview, IL (US)

( * ) Notice: Subject to any disclaimer, the term of this patent is extended or adjusted under 35 U.S.C. 154(b) by 268 days.

This patent is subject to a terminal disclaimer.

(21) Appl. No.: 11/415,058

(22) Filed: May 1, 2006

(51) Int. Cl.
*A44B 11/25* (2006.01)
*A44B 11/26* (2006.01)

(52) U.S. Cl. ..... 24/614; 24/615; 24/625

(58) Field of Classification Search ..... 24/614, 24/615, 625, 662
See application file for complete search history.

(56) References Cited

U.S. PATENT DOCUMENTS

| | | | | |
|---|---|---|---|---|
| 2,933,795 | A | 4/1960 | Meeker | |
| 5,832,573 | A | 11/1998 | Howell | |
| 6,154,935 | A | 12/2000 | Gregory et al. | |
| 6,154,936 | A * | 12/2000 | Howell et al. | 24/625 |
| 6,637,083 | B1 | 10/2003 | Howell | |
| 7,100,251 | B2 * | 9/2006 | Howell | 24/602 |
| 7,107,657 | B1 * | 9/2006 | Howell | 24/614 |
| 2004/0221432 | A1 * | 11/2004 | Nezu | 24/614 |
| 2006/0080811 | A1 | 4/2006 | Grimm | |
| 2006/0123607 | A1 * | 6/2006 | Howell | 24/615 |

FOREIGN PATENT DOCUMENTS

| | | |
|---|---|---|
| EP | 0427525 | 5/1991 |
| EP | 1206916 | 5/2002 |

* cited by examiner

*Primary Examiner*—Robert J Sandy
*Assistant Examiner*—Ruth C. Rodriguez
(74) *Attorney, Agent, or Firm*—Gauthier & Connors LLP

(57) ABSTRACT

A quick release buckle has male and female components releasably joined in snap engagement. A release lever on the female component provides a means of disengaging the components. The release lever may be actuated either by pulling on a lanyard cord to which it is connected, or by accessing a lift tab projecting from its forward end.

9 Claims, 4 Drawing Sheets

QUICK RELEASE BUCKLE

BACKGROUND DISCUSSION

1. Field of the Invention

This invention relates to lanyard style quick-release buckles of the type used to detachably connect straps in backpacks and the like.

2. Description of the Prior Art

Lanyard style quick-release buckles are known, as disclosed for example by U.S. Pat. No. 6,637,083 (Howell). While such buckles are entirely serviceable, experience has indicated that they have a number of shortcomings. For example, their design does not provide a convenient way of parting the interlocked buckle components without using the lanyard. The release levers of the female components are prone to being overstressed and broken by excessive pulling forces on the lanyards. Lanyards are limited to thin webs that are generally sewn into place, and the lanyards are susceptible to inadvertent snagging, resulting in unintended parting of the buckle components.

The objective of the present invention is to obviate or at least significantly minimize these shortcomings.

SUMMARY OF THE INVENTION

In accordance with one aspect of the present invention, a quick release buckle comprises interengageable female and male components. The female component has bottom and side walls coacting to define a receiving channel having an access opening at a front end and a rear wall at a rear end. A resiliently deflectable release lever overlies the receiving channel and is supported in cantilever fashion by the rear wall. The release lever has a catch on its underside and a forward end projecting beyond the front end of the receiving channel to define a lift tab.

The male component includes a tongue projecting forwardly from a base. The tongue is configured and dimensioned for insertion into the receiving channel of the female component via its access opening, and a shoulder on the tongue coacts in snap engagement with the catch on the release lever to retain the two components in an interlocked relationship. The lift tab overlies and is spaced above the base of the male component to thereby provide a means of prying or otherwise upwardly deflecting the release lever to disengage its catch from the tongue shoulder and thereby accommodate separation of the buckle components.

The lift tab is preferably provided with an aperture configured to accept a cord serving as a release lanyard.

Preferably, the lift tab is angled upwardly to prevent the lanyard cord from obstructing the access opening of the female component's receiving channel.

Preferably, the base of the male component is configured with a notch into which the lanyard cord may be releaseably tucked and thus safeguarded from inadvertent snagging.

In accordance with still another aspect of the present invention, the side walls of the female component have stops that overlap and limit the extent to which the release lever can be upwardly deflected, thus safeguarding the release lever from being excessively stressed and broken.

These and other features and advantages of the present invention will now be described in further detail with reference to the accompanying drawings, wherein:

DETAILED DESCRIPTION

Figure 1:
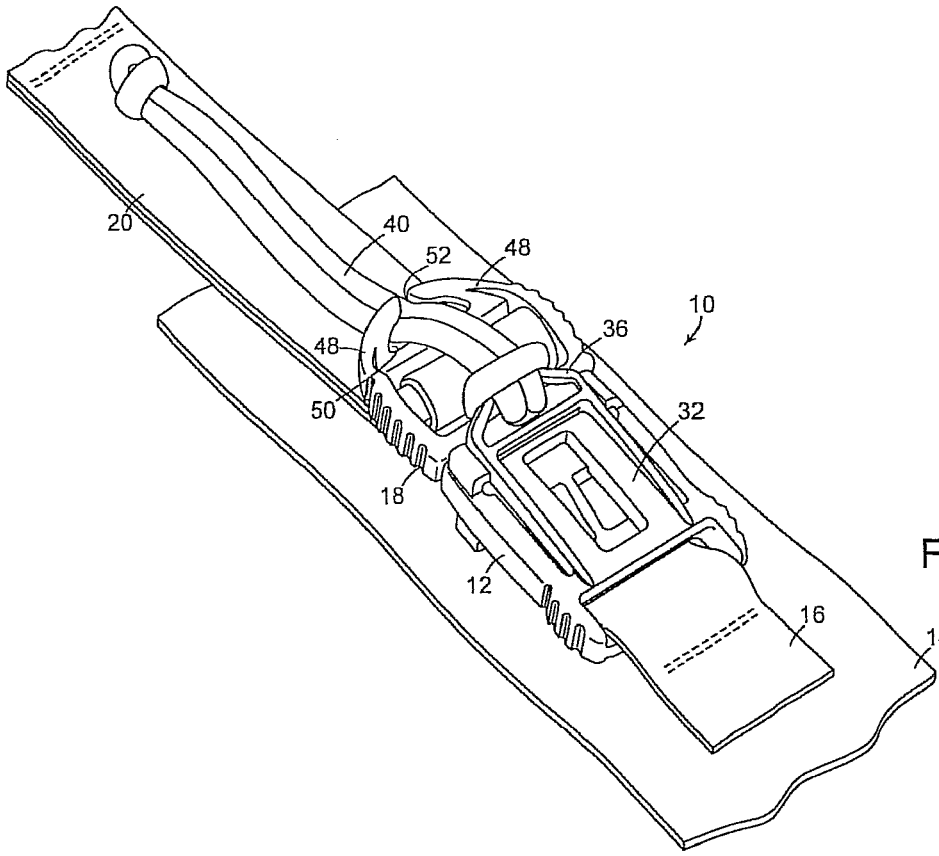
FIG. 1 is a perspective view of a quick release buckle in accordance with the present invention.
Figure 2:
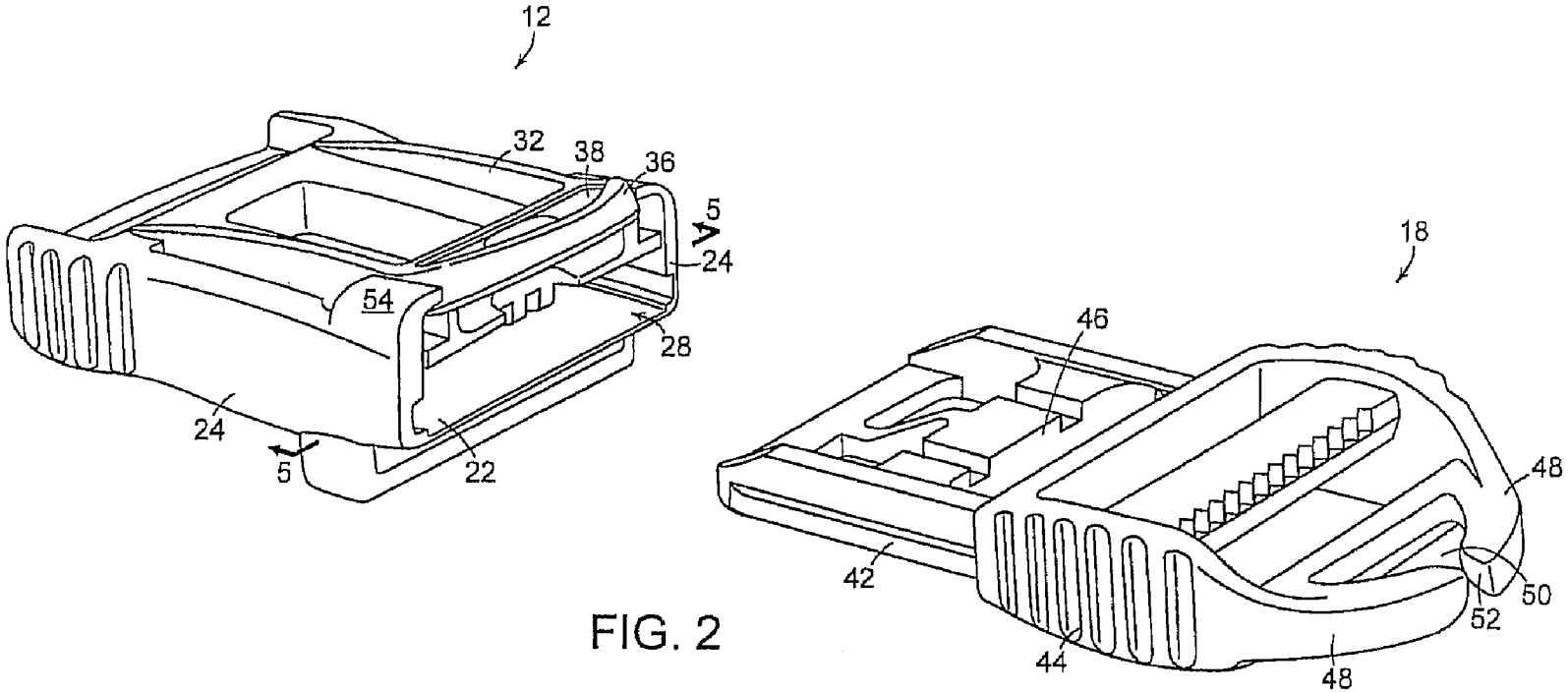
FIG. 2 is an exploded perspective view of the male and female components of the buckle.
Figure 3:
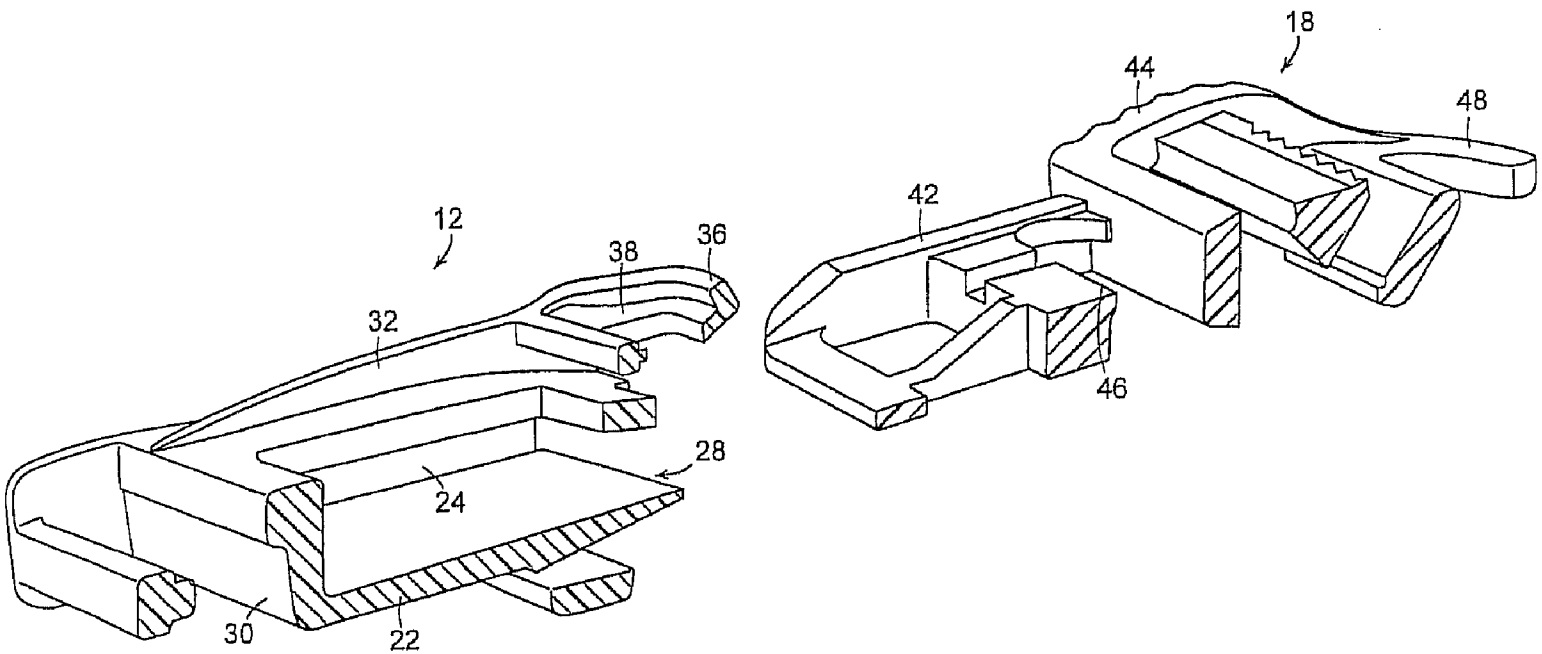
FIG. 3 is a sectional perspective view of the exploded buckle components.

With reference initially to FIG. 1, a quick release buckle in accordance with the present invention is shown at 10. The buckle comprises a female component 12 connected to a web 14 by a stitched strap 16, and a male component 18 connected to another web 20.

With reference additionally to the remaining Figures, it will be seen that the female component 12 has a bottom 22 and side walls 24 coacting to define a receiving channel 26 having an access opening 28 at its front end and a rear wall 30 at its rear end. A resiliently deflectable release lever 32 overlies the receiving channel 26 and is supported in cantilever fashion by the rear wall 30. The release lever has a catch 34 on its underside, and a forward end projecting beyond the access opening at the front end of the receiving channel to define a life tab 36. The lift tab 36 is angled upwardly away from the access opening 28, and is provided with an aperture 38 configured and dimensioned to accept dual strands of a lanyard release cord 40.

The male component 18 has a tongue 42 projecting forwardly from a base 44. A shoulder 46 on the tongue coacts in snap engagement with the catch 34 on the underside of the release lever 32 to retain the tongue in the receiving channel 26 and thus establish an interlocked relationship between the two buckle components 12, 18. By upwardly deflecting the release lever 32, the catch 34 can be freed from shoulder 46 to allow tongue 42 to be retracted from the receiving channel 26, resulting in separation of the buckle components 12, 18.

Figure 4:
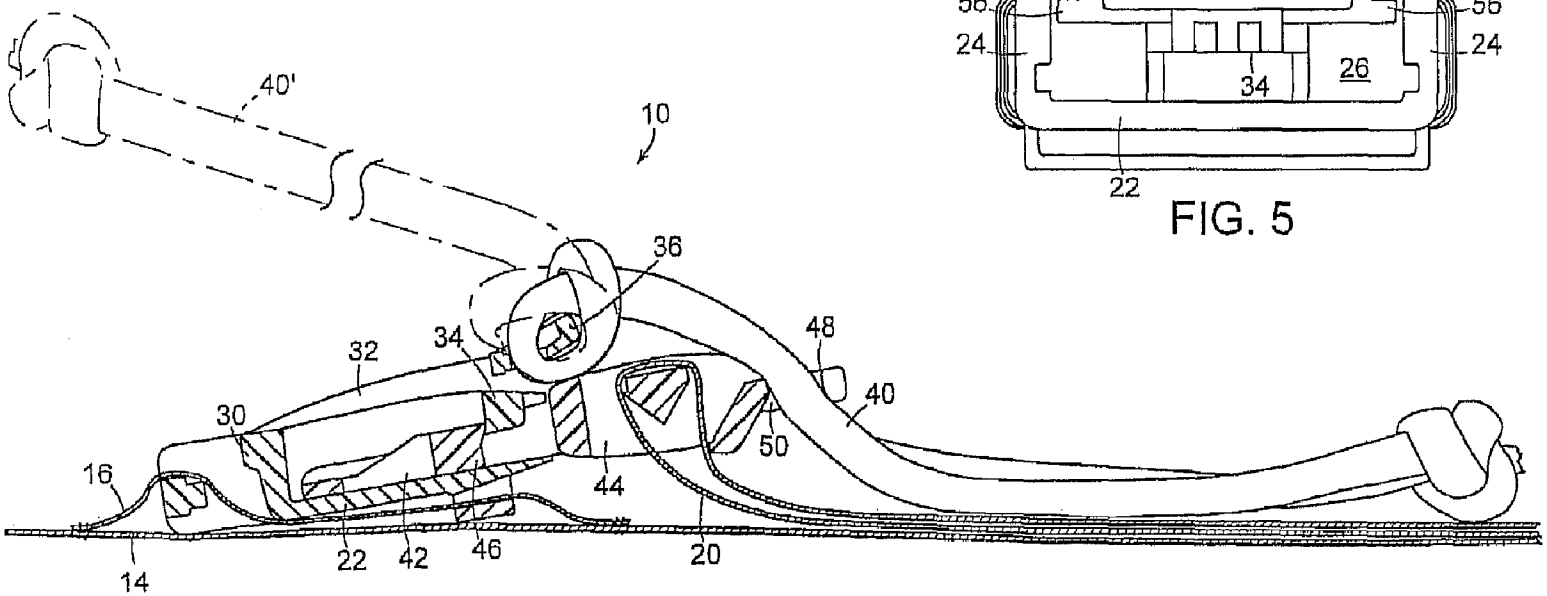
FIG. 4 is a sectional view of the assembled buckle components.

When the two buckle components are mechanically interengaged, as shown in FIGS. 1 and 4, the lift tab 36 of the release lever 32 is spaced above the base 44 of the male component 18. The release lever 32 may be deflected upwardly either by prying or otherwise forcing the lift tab 36 upwardly, or by pulling on the lanyard release cord 40 when it is in the position shown by the broken lines at 40' in FIG. 4. It can also be seen from FIG. 4 that the upwardly inclined disposition of the lift tab 36 serves to retain the lanyard release cord 40 above the access opening 28 at a location that does not interfere with insertion of the tongue 42 into the receiving channel 26.

The base 44 of the male component 18 is advantageously provided with rearwardly projecting curved fingers 48 defining a notch 50. The tips of the curved fingers are spaced one from the other to define a slot 52 communicating with the notch 50. The lanyard cord 40 may be forced through the slot 52 and tucked into the notch 50. When thus positioned, as shown by the solid lines in FIGS. 1 and 4, the lanyard cord is safeguarded against inadvertent snagging, which can result in the release lever 32 being pulled upwardly unintentionally.

Figure 5:
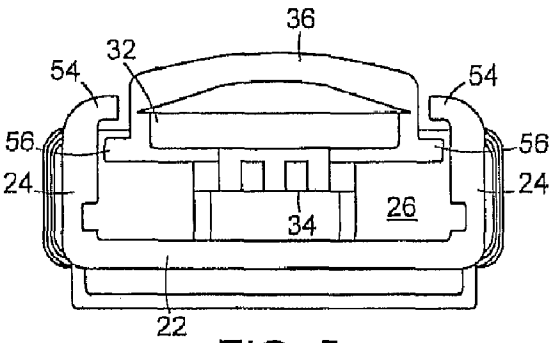
FIG. 5 is an end view of the female component taken on line 5-5 of FIG. 2.

As can best be seen in FIG. 5, the side walls 24 of the female component 12 are advantageously provide with integral stops 54 positioned to overlap laterally projecting ears 56 on the release lever 32. The vertical spacing between the stops 54 and the ears 56 establishes a limit to upward deflection of the release lever 32. With this arrangement, excessive upward forces exerted on the release lever will be resisted by the stops 54 on the rigid and more robust side walls 24, thus safeguarding the release lever from being overstressed and broken.

I claim:

1. A quick release buckle comprising:

a female component having a bottom and side walls coacting to define a receiving channel with an access opening at a front end and a rear wall at a rear end;

a release lever overlying said receiving channel and supported in cantilever fashion by said rear wall, said release lever having a catch on its underside and a forward end projecting beyond said front end to define a lift tab, wherein said lift tab includes an aperture;

a lanyard release cord threaded through said aperture; and a male component with a tongue projecting forwardly from a base, a shoulder on said tongue, said tongue being configured and dimensioned for insertion into said receiving channel via said access opening, and said release lever being resiliently deflectable to accommodate snap engagement of said catch with said shoulder to thereby retain said male component in an interlocked relationship with said female component, with the lift tab of said release lever overlying and spaced above the base of the thus retained male component to thereby provide a means of upwardly deflecting said release lever to disengage said catch from said shoulder and free said tongue for withdrawal from said receiving channel, wherein said male component further includes a notch at a rear end of said male component, said notch releasably retains said lanyard release cord when the male component is engaged with the female component.

2. The quick release buckle of claim 1 wherein said lift tab is angled upwardly from said access opening.

3. The quick release buckle of claim 1 wherein said notch is defined by a pair of curved fingers projecting rearwardly from said base, said fingers having mutually spaced tips defining a slot dimensioned to accommodate tucking of said lanyard release cord into said notch.

4. The quick release buckle of claim 1 further comprising stops on said side walls, said stops being positioned to overlap and limit the extent to which said release lever may be upwardly deflected.

5. A quick release buckle comprising:

a female component having a bottom and side walls coacting to define a receiving channel with an access opening at a front end and a rear wall at a rear end;

a release lever overlying said receiving channel and supported in cantilever fashion by said rear wall, said release lever having a catch on its underside and a forward end projecting beyond said front end to define a lift tab, wherein said side walls further include stops on said side walls, said stops being positioned to overlap and limit the extent to which said release lever may be upwardly deflected;

a male component with a tongue projecting forwardly from a base, a shoulder on said tongue, said tongue being configured and dimensioned for insertion into said receiving channel via said access opening, and said release lever being resiliently deflectable to accommodate snap engagement of said catch with said shoulder to thereby retain said male component in an interlocked relationship with said female component, with the lift tab of said release lever overlying and spaced above the base of the thus retained male component to thereby provide a means of upwardly deflecting said release lever to disengage said catch from said shoulder and free said tongue for withdrawal from said receiving channel.

6. The quick release buckle of claim 5 further comprising an aperture in said lift tab, and a lanyard release cord threaded through said aperture.

7. The quick release buckle of claims 5 or 6 wherein said lift tab is angled upwardly from said access opening.

8. The quick release buckle of claim 6 further comprising a notch at a rear end of said male component, said notch being configured and dimensioned to releasably retain said lanyard release cord.

9. The quick release buckle of claim 8 wherein said notch is defined by a pair of curved fingers projecting rearwardly from said base, said fingers having mutually spaced tips defining a slot dimensioned to accommodate tucking of said lanyard release cord into said notch.

* * * * *